US007341293B2

(12) United States Patent
Tsai

(10) Patent No.: US 7,341,293 B2
(45) Date of Patent: Mar. 11, 2008

(54) DETACHABLE CHOPSTICK

(76) Inventor: Sen-Jun Tsai, No. 10, Lane 45, Chung Hsing Street, Yung Kang City, Tainan County (TW)

( * ) Notice: Subject to any disclaimer, the term of this patent is extended or adjusted under 35 U.S.C. 154(b) by 143 days.

(21) Appl. No.: 11/378,344

(22) Filed: Mar. 20, 2006

(65) Prior Publication Data

US 2007/0216176 A1 Sep. 20, 2007

(51) Int. Cl.
*A47G 21/10* (2006.01)

(52) U.S. Cl. ..... 294/1.1; 294/5.5

(58) Field of Classification Search ..... 294/1.1, 294/5.5; 30/322, 324; 403/377; 15/144.4
See application file for complete search history.

(56) References Cited

U.S. PATENT DOCUMENTS 2,523,041 A * 9/1950 McKenzie ..... 81/436
3,637,248 A * 1/1972 Arita ..... 294/99.2
5,431,465 A * 7/1995 Shibata ..... 294/1.1
5,810,411 A * 9/1998 Major ..... 294/99.2
5,927,161 A * 7/1999 Clifford et al. ..... 81/177.2
6,223,391 B1 * 5/2001 Kuo ..... 16/113.1
6,402,214 B1 * 6/2002 Weiner ..... 294/99.2

FOREIGN PATENT DOCUMENTS

JP 04215712 * 8/1992
JP 11004744 * 1/1999
JP 11009417 * 1/1999

* cited by examiner

*Primary Examiner*—Dean J Kramer

(57) ABSTRACT

A chopstick comprises an upper body having a penetrating receiving chamber; an upper inner side of the receiving chamber being formed with an annular groove; a lower end of the upper body having two through holes; a lower body having an insertion section at an upper end thereof; a wall surface of the insertion section having a receiving chamber; one end of the receiving chamber having a through hole; a ball, a spring, and a retaining block being sequentially installed in the receiving chamber; the ball being protruded into the through hole; the retaining block being retained in the receiving chamber; and the spring and ball are positioned in the receiving chamber. A clamping unit is attached to the upper body. The clamping unit has two holes for receiving a pair of chopsticks. A lower end of the lower body has a brush; and the brush has brush hairs.

3 Claims, 8 Drawing Sheets

DETACHABLE CHOPSTICK

FIELD OF THE INVENTION

The present invention relates to chopsticks, and particularly to a detachable chopstick, wherein the chopstick can be assembled quickly and conveniently. Thereby, it has a small volume and can be carried conveniently. No receiving box is necessary. The receiving chamber in the receiving chamber can be cleaned.

BACKGROUND OF THE INVENTION

Currently, people often eat out. Therefore, disposable chopsticks are frequently used. However the disposable chopsticks are generally not clean. Dirt and germs are easily attached thereon so as to be harmful to human body. Moreover, antiseptics are added to the chopstick in the manufacturing process. If people use this kind of chopstick for a long time, they will be easy to get cancers. Moreover, a large amount of disposable chopsticks are deserted. They are harmful to the environment. Further, the manufacturing of chopsticks will induce a large amount of woods to be cut. Thus it is also disadvantageous to the environment.

More and more people take chopsticks for eating out. However the chopsticks are long and thus they are inconvenient to take the chopsticks. The detachable chopstick is developed. In that, an upper body is screwed to the lower body. When the upper body and lower body are attached, they can be stored in a receiving box so as to have a small length. However the receiving box makes the full volume increase.

SUMMARY OF THE INVENTION

Accordingly, the primary object of the present invention is to provide a chopstick, wherein the chopstick can be assembled quickly and conveniently. Thereby, it has a small volume and can be carried conveniently. No receiving box is necessary. The cost is down. The receiving chamber in the receiving chamber can be cleaned.

To achieve above objects, the present invention provides a chopstick which comprises an upper body having a penetrating receiving chamber; an upper inner side of the receiving chamber being formed with an annular groove; a lower end of the upper body having two through holes; a lower body having an insertion section at an upper end thereof; a wall surface of the insertion section having a receiving chamber; one end of the receiving chamber having a through hole; a ball, a spring, and a retaining block being sequentially installed in the receiving chamber; the ball being protruded into the through hole; the retaining block being retained in the receiving chamber; the spring and ball are positioned in the receiving chamber. A clamping unit is attached to the upper body. The clamping unit has two holes for receiving a pair of chopsticks. A lower end of the lower body has a brush; and the brush has brush hairs.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
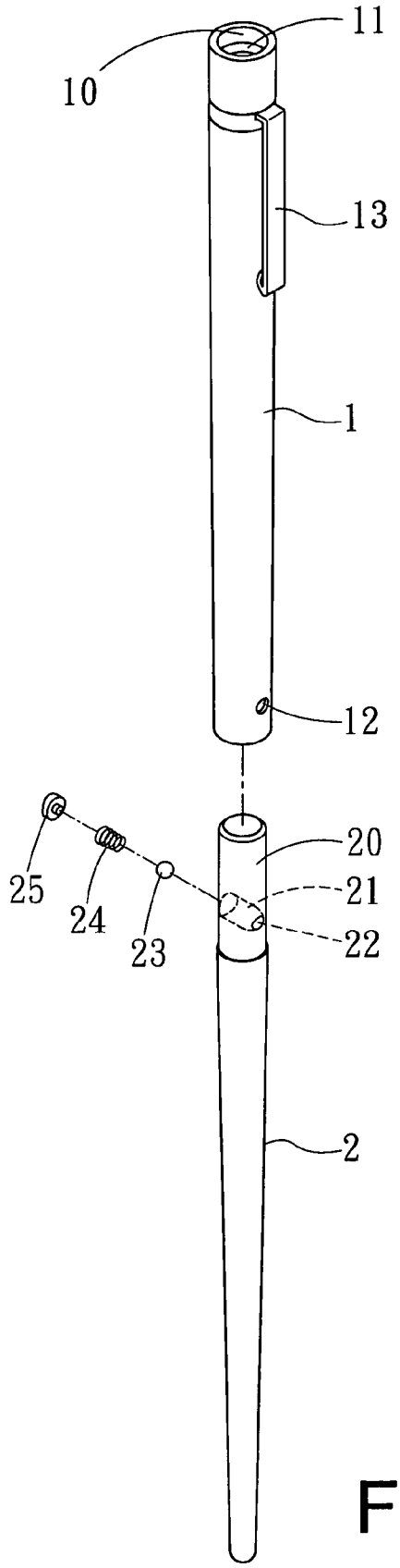
FIG. 1 is an exploded perspective view of the present invention.
Figure 2:
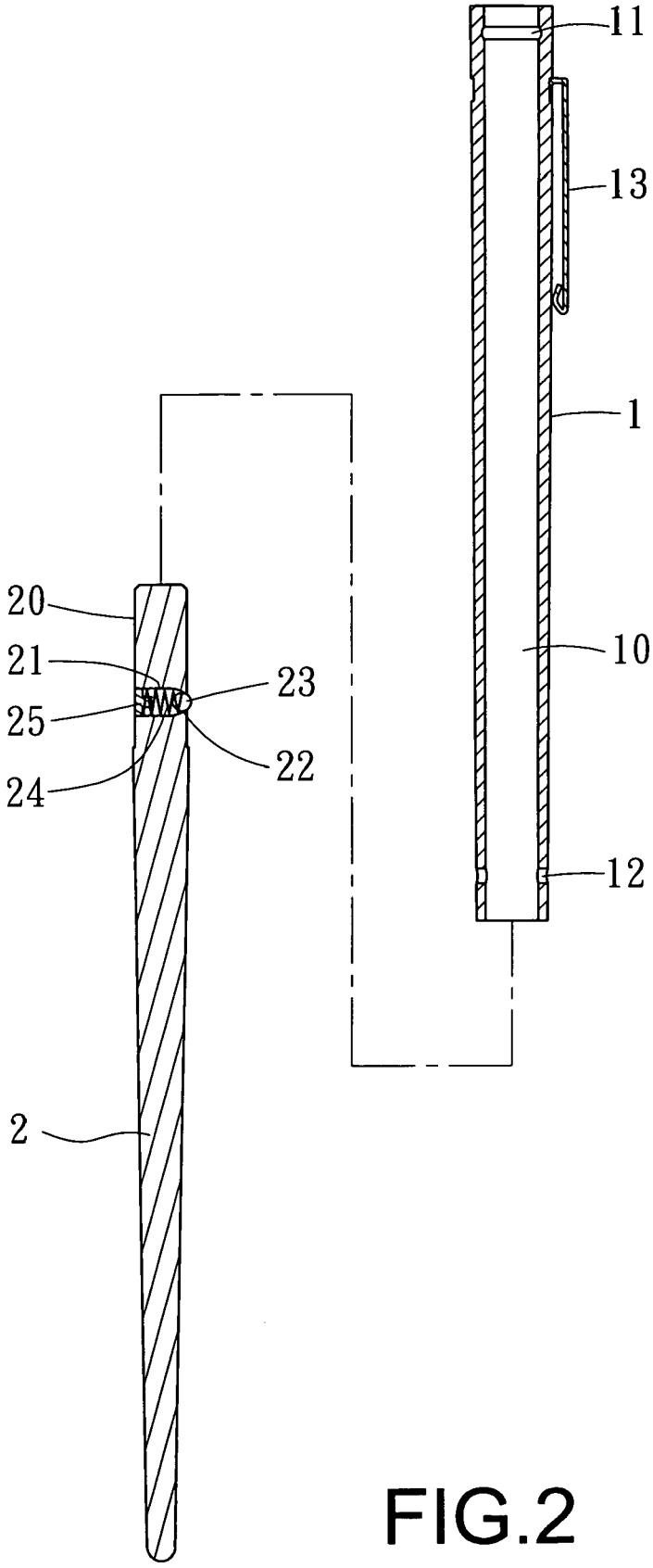
FIG. 2 is a plan view about the detachment of the upper body and lower body of the present invention.

Referring to FIGS. 1 and 2, the chopsticks of the present invention will be described herein.

An upper body 1 has a penetrating receiving chamber 10. An upper inner side of the receiving chamber 10 is formed with an annular groove 11. A lower end of the upper body 1 has two through holes 12. A clamping unit 13 is attached to the upper body 1.

A lower body 2 has an insertion section 20 at upper end thereof. A wall surface of the insertion section 20 has a receiving chamber 21. One end of the receiving chamber 21 has a through hole 22. A ball 23, a spring 24, and a retaining block 25 are sequentially installed in the receiving chamber 21. The ball 23 is protruded into the through hole 22. The retaining block 25 is retained in the receiving chamber 21. The spring 24 and ball 23 are positioned in the receiving chamber 21.

Figure 3:
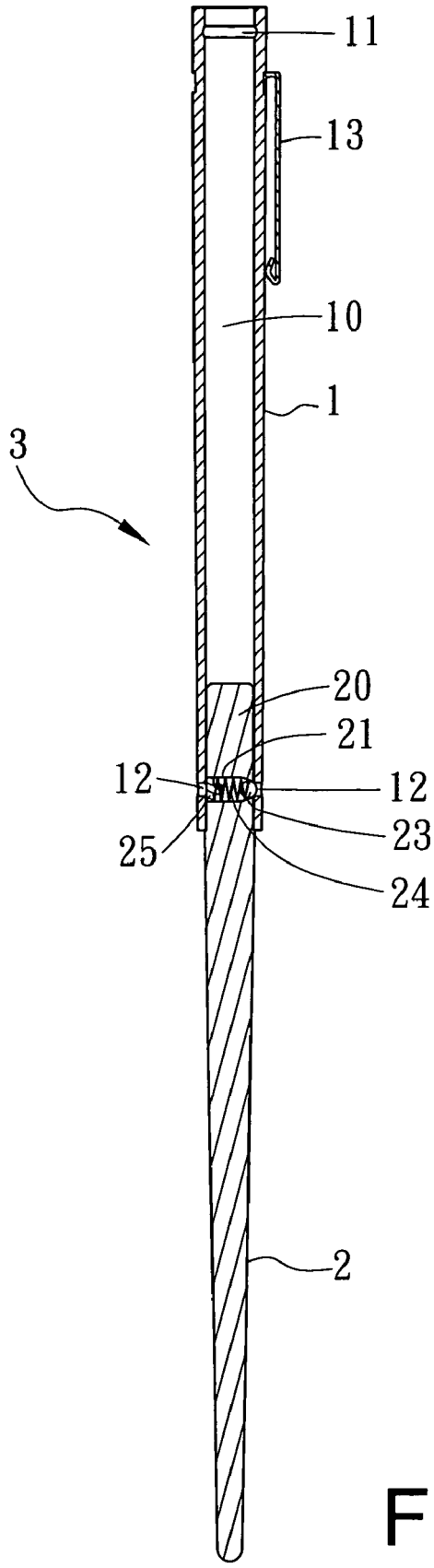
FIG. 3 is a cross sectional view of the present invention.
Figure 4:
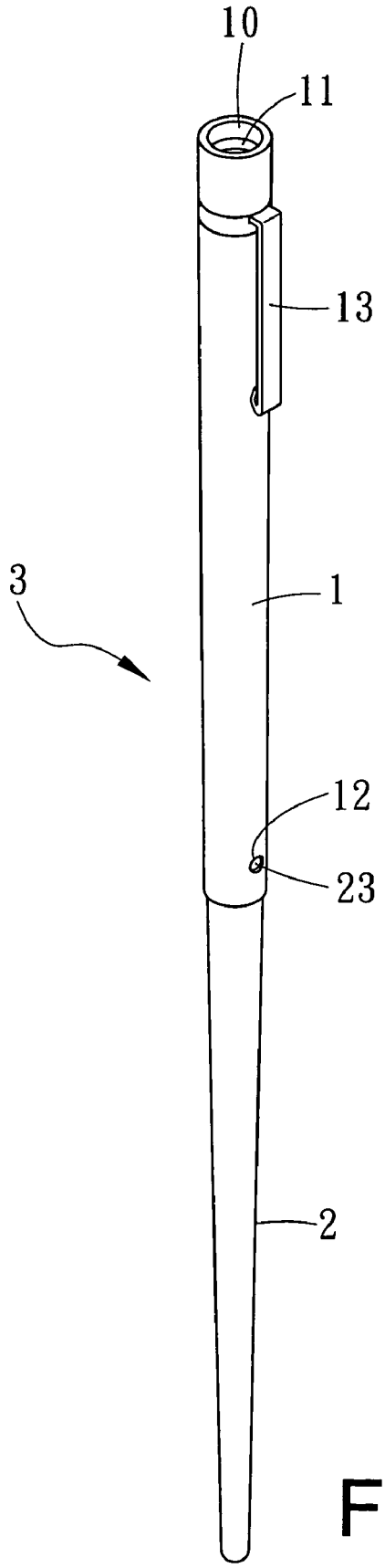
FIG. 4 shows an assembled view of the present invention.

In use, referring to FIGS. 2, 3, and 4, the insertion section 20 of the lower body 2 is inserted into a lower end of the receiving chamber 10 of the upper body 1. The ball 23 resists against the inner wall of the receiving chamber 10 of the upper body 1 to reduce into the receiving chamber 21 of the lower body 2. The reduced ball 23 will compress the spring 24. When the ball 23 is at the through hole 12 of the upper body 1, it will release from the inner wall of the receiving chamber 10 so that the spring 24 will resilient back. The ball 23 is ejected out to be buckled to the through hole 12 of the upper body 1. Therefore, the lower body 2 is assembled to the lower side of the upper body 1 to be formed as a complete chopstick 3 (referring to FIG. 4). By above mentioned method, the chopsticks 3 can be assembled rapidly and easily.

Figure 5:
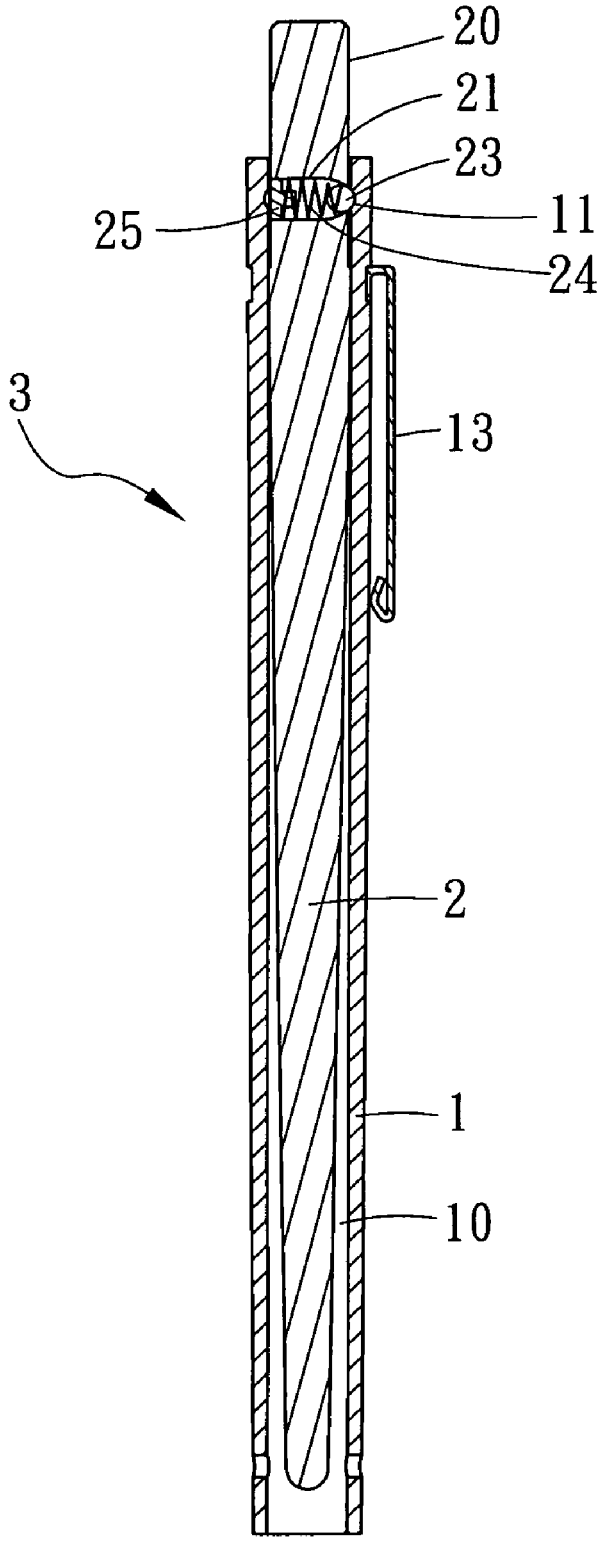
FIG. 5 is a cross sectional view showing the storage of the present invention.
Figure 6:
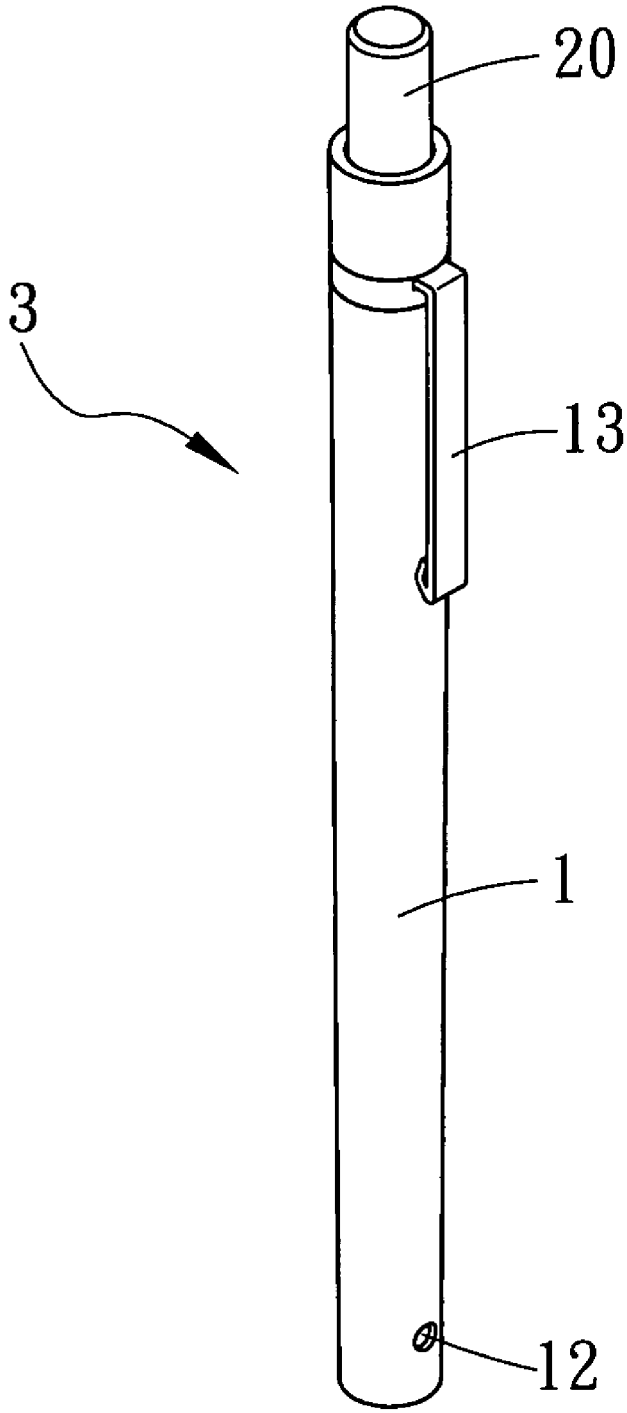
FIG. 6 is a perspective view about the storage state of the present invention.
Figure 7:
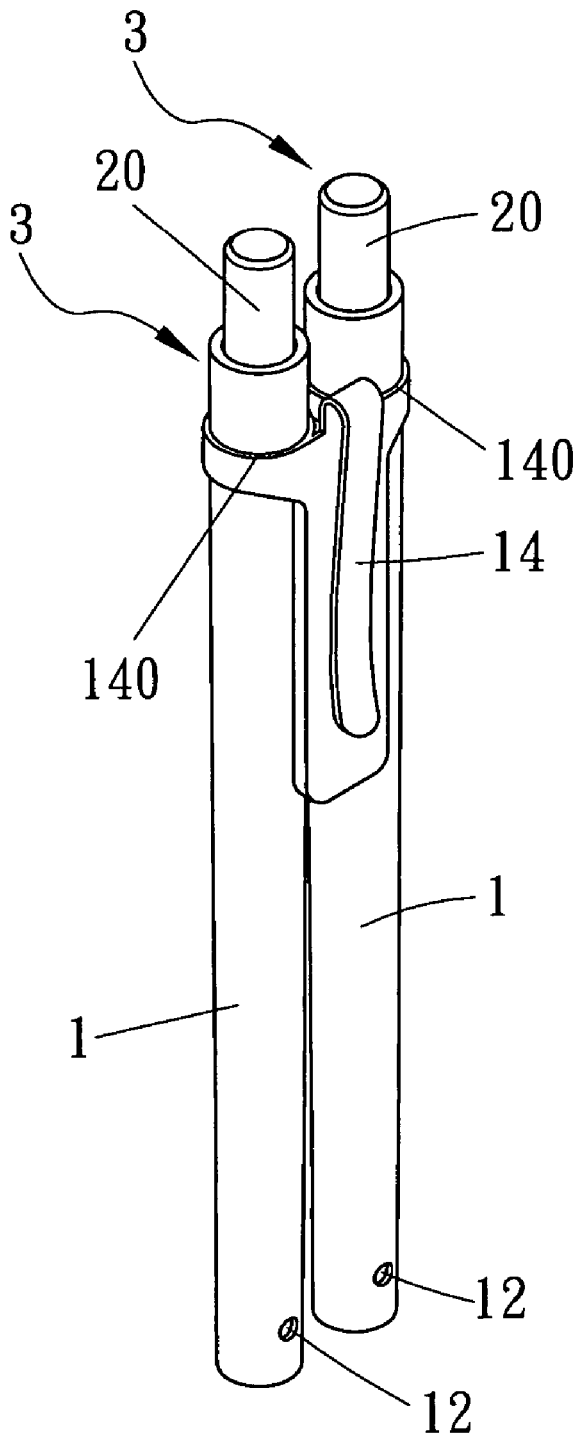
FIG. 7 is a schematic view showing another embodiment of the present invention.

When the chopstick 3 is not used, referring to FIGS. 5 and 6, a force is applied to the lower body 2 downwards so as to draw the upper body 1. The ball 23 is compressed by the inner wall of the receiving chamber 10 of the upper body 1 to reduce into the receiving chamber 21 of the lower body 2 and thus to compress the spring 24. Thereby, the lower body 2 is released from the upper body 1 (referring to FIG. 2). Then the lower body 2 is inserted into the receiving chamber 10 from the upper end of the upper body 1 (referring to FIG. 5). The ball 23 of the lower body 2 is pressed by the inner wall of the receiving chamber 10 of the upper body 1 to reduce into the receiving chamber 21 of the lower body 2 and then to compress the spring 24. When the ball 23 is positioned at the annular groove 11 of the receiving chamber 10 of the upper body 1, the ball 23 is pushed out by the elastic force of the spring 24 to be buckled into the annular groove 11. Therefore, the lower body 2 is installed in the receiving chamber 10 of the upper body 1. An upper end of the insertion section 20 of the lower body 2 protrudes out from the upper side of the upper body 1. In use, the lower body 2 can be drawn out from the upper body 1 easily and in storage, the outlook of the chopstick 3 is like a pen (referring to FIG. 6). Then the chopstick 3 can be attached to a pocket by the clamping unit 13. Furthermore a pair of chopsticks 3 can be inserted into a retaining damper 14 (referring to FIG. 7). Thus a pair of chopsticks 3 can be stored and carried easily and conveniently.

Figure 8:
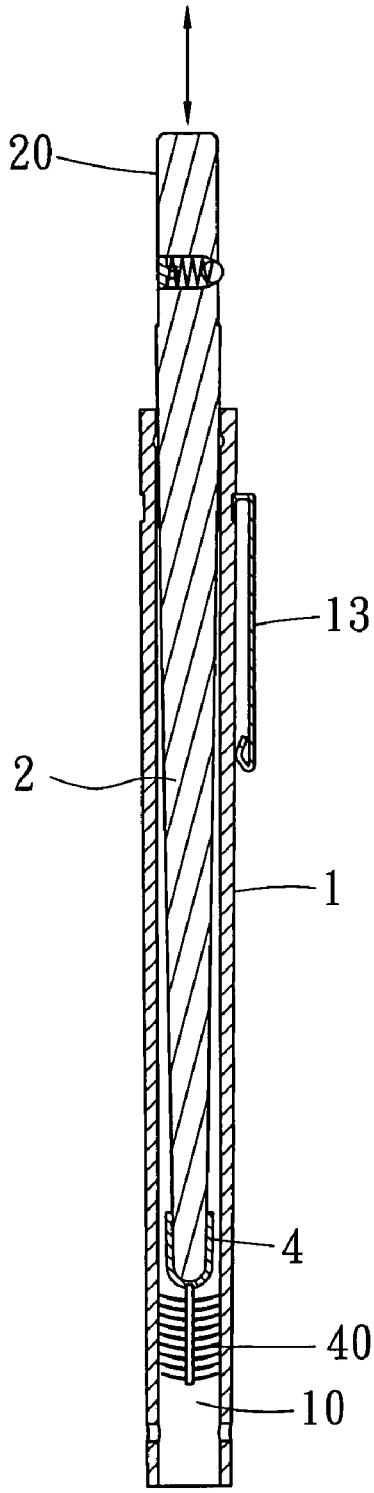
FIG. 8 is a schematic view showing the cleaning way according to the present invention.

If it is desired to clean the chopsticks, referring to FIG. 8, the lower body 2 and upper body 1 are cleaned. A lower end of the lower body 2 has a brush 4. The brush 4 has brush hairs 40. When the lower body 2 is inserted into the receiving chamber 10 of the upper body 1 and reciprocally moves the lower body 2, the brush hairs 40 of the brush 4 will clean the inner wall of the receiving chamber 10 of the upper body 1. Thus, no dirt is accumulated in the receiving chamber 10.

Advantages of the present invention will be described herein. The present invention can be assembled quickly and conveniently. Thereby, the present invention has a small volume and can be carried conveniently. No receiving box is necessary. The cost is down. The receiving chamber in the receiving chamber can be cleaned.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A chopstick comprising: an upper body having a penetrating receiving chamber;

an upper inner side of the receiving chamber being formed with an annular groove; a lower end of the upper body having two through holes;

a lower body having an insertion section at an upper end thereof; a wall surface of the insertion section having a receiving chamber; one end of the receiving chamber having a through hole; a ball, a spring, and a retaining block being sequentially installed in the receiving chamber; the ball being protruded into the through hole; the retaining block being retained in the receiving chamber; and the spring and ball are positioned in the receiving chamber; and wherein a lower end of the lower body has a brush; the brush has brush hairs; when the lower body is inserted into the receiving chamber of the upper body and reciprocally moves therein, the brush hairs of the brush will clean the inner wall of the receiving chamber of the upper body.

2. The chopstick as claimed in claim 1, wherein a clamping unit is attached to the upper body.

3. The chopstick as claimed in claim 2, wherein the clamping unit has two holes for receiving a pair of chopsticks.

* * * * *